United States Patent [19]

Leurent

[11] Patent Number: 4,587,776

[45] Date of Patent: May 13, 1986

[54] ROOFING STRUCTURE

[75] Inventor: Ghislain Leurent, Tourcoing, France

[73] Assignee: Brelan S.A., Luxembourg-Ville, Luxembourg

[21] Appl. No.: 466,471

[22] Filed: Feb. 15, 1983

[51] Int. Cl.[4] ..... E04B 1/32; E04B 7/18

[52] U.S. Cl. ..... 52/86; 52/200; 52/463

[58] Field of Search ..... 52/86, 200, 460, 461, 52/463, 464; 49/DIG. 1

[56] References Cited

U.S. PATENT DOCUMENTS

| | | | |
|---|---|---|---|
| 2,575,655 | 11/1951 | Clerk | 49/DIG. 1 |
| 2,948,362 | 8/1960 | Jones | 52/464 |
| 3,762,120 | 10/1973 | Janssen | 52/200 |
| 3,791,088 | 2/1974 | Sandow | 52/200 |
| 3,844,087 | 10/1974 | Schultz | 52/200 |
| 3,999,336 | 12/1976 | Bance | 52/464 |
| 4,114,330 | 9/1978 | Sukdics | 52/200 |
| 4,428,169 | 1/1984 | Tsakiris | 52/200 |
| 4,455,798 | 6/1984 | Tsakiris | 52/200 |

FOREIGN PATENT DOCUMENTS

| | | | |
|---|---|---|---|
| 473433 | 5/1951 | Canada | 52/86 |
| 608070 | 12/1978 | Switzerland | 49/DIG. 1 |

*Primary Examiner*—Henry E. Raduazo

*Attorney, Agent, or Firm*—McAulay, Fields, Fisher, Goldstein & Nissen

[57] ABSTRACT

A roofing structure, for forming for example a vault, possibly transparent or translucent, is adapted to cover a zone located between two supports generally parallel in a longitudinal direction. This structure is composed of a plurality of juxtaposed roofing plates located at one or more levels, and of hoop elements disposed transversaly between the two longitudinal supports. Each of these hoop elements is constituted by at least two elementary hoop elements comprising a lower hoop element and an upper hoop element superposed on the lower hoop element. The transverse edges of the roofing plates are engaged between the lower and upper hoop elements of each pair. The roofing structure comprises means for provoking the deformation of one of the superposed hoop elements by applying it under pressure against the other and thus effecting gripping of the roofing plates between the superposed elementary hoop elements, without any seal.

6 Claims, 38 Drawing Figures

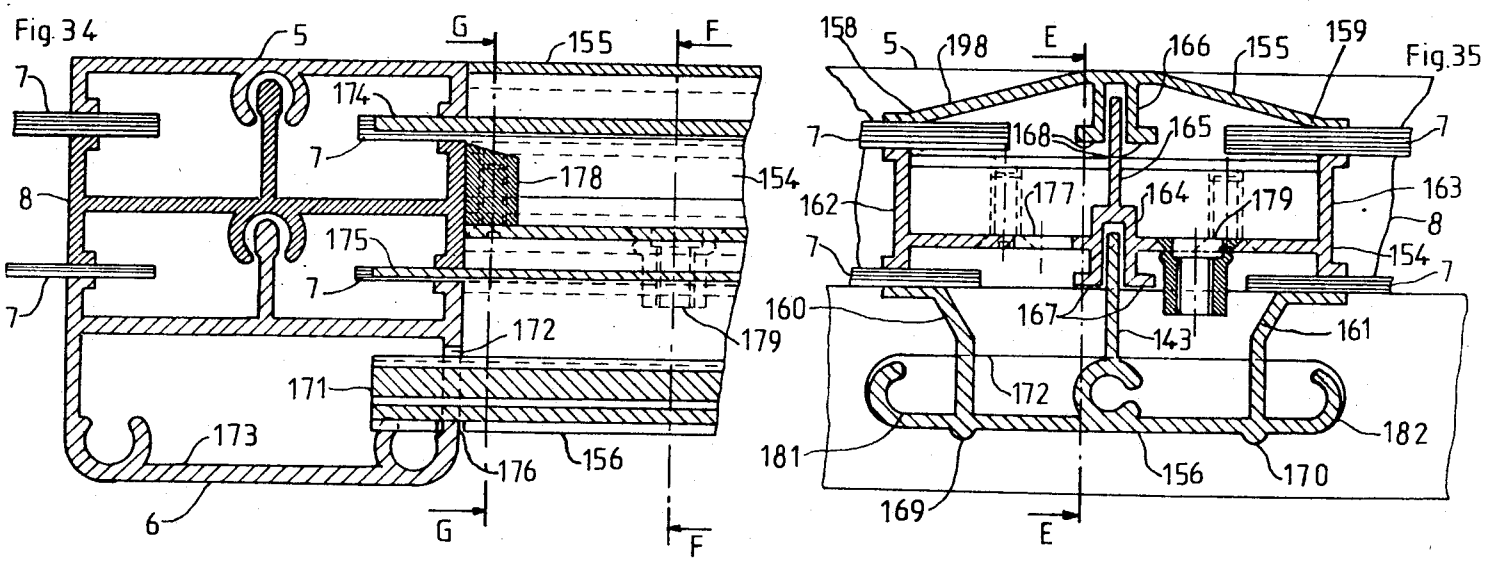
Fig.35
Fig.34
E
F
G
5
6
7
8
143
154
155
156
158
159
160
161
162
163
164
165
166
167
168
169
170
171
172
173
174
175
176
177
178
179
181
182
198
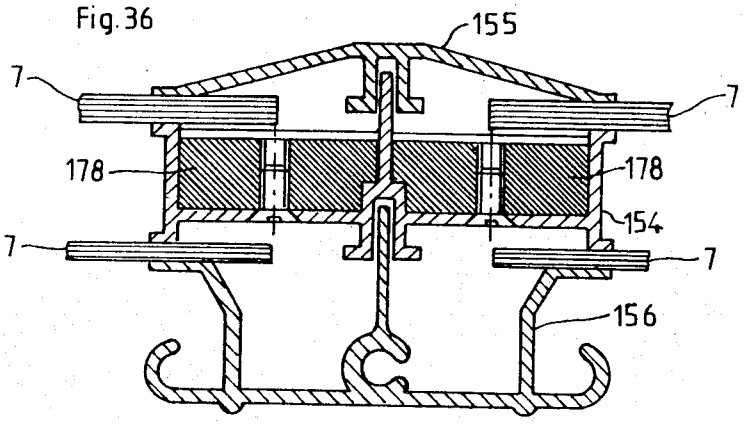
Fig.36
7
154
155
156
178

ROOFING STRUCTURE

BACKGROUND OF THE INVENTION

The present invention relates to a roofing structure, for example for making a generally transparent or translucent vault for covering a defined zone.

The structure according to the invention makes it possible, particularly but not exclusively, to make portions of transparent or translucent surfaces in the roof of a building, the roofing of corridors, passages, shelters, porches, etc.

Structures of this type are generally constituted by a plurality of transparent or translucent plates, for example made of plastics material, fixed by being gripped between hoop elements and possibly crosspieces which define its frame.

Such structures must comply with criteria of tightness, aesthetics, ease of assembly and occasionally ease of modification of the structure, for example by adding other surface levels thereto whilst using the structure which has already been positioned. Furthermore, they generally use materials of different natures which, in particular, present different coefficients of expansion. When the structure is made, it is therefore necessary to take into account the differences in expansion in the materials assembled together.

Presently existing structures are described, for example, in U.S. Pat. Nos. 2,842,073, 3,307,309, 3,325,951, 3,473,276, 3,434,250 and 3,762,120. Some of these structures are constituted by plates of which the transverse edges are housed between superposed curved sections constituting the transverse hoop elements of the structure. These sections are generaly made of metal, steel or aluminium alloy, and a seal may be interposed between a plate and a section or between a plate and each of the superposed sections.

In such a structure the two upper and lower transverse sections constituting each hoop element are rendered fast with each other, at each end, by means of a locking screw which is screwed in an open tubular rib provided on the inner face of the upper section. This open tubular rib presents an outer diameter substantially equal to the distance separating two ribs provided on the inner face of the lower section and betwen which is engaged the open tubular rib fast with the upper section. Consequently, the engagement of the locking screw in the open tubular rib provokes to some extent a diametrical expansion of the latter which is applied firmly against the two ribs fast with the lower section. Such a structure consequently presents the drawback of not ensuring a good seal, as the two sections of each hoop element are connected to each other by an effort exerted parallel to the plate of which the edge is housed between the two sections.

The above drawback is also met with at the joint between the connecting crosspieces perpendicular to the hoop elements and these hoop elements, when these crosspieces are present in the structure. The connection between the crosspieces and the hoop elements is generally not very water-tight.

SUMMARY OF THE INVENTION

It is an object of the present invention to propose a structure which overcomes the above-mentioned drawbacks, which complies with the criteria of seal, aesthetics, ease of assembly and ease of adaptation of additional walls to a structure which is already in position, and which, moreover, allows free expansion of the plates with respect to the frame.

It is another object of the invention to propose a structure in which the plates and sections, constituting hoop elements or crosspieces, are assembled together without seals, whilst ensuring a perfect, effective seal.

Yet another object of the invention is to propose a structure in which the assembly of the sections constituting the hoop elements and the sections constituting the connecting crosspieces, when the latter are present, is homogeneous and the joint between the crosspieces and the hoop elements prevents possible infiltrations of water inside the construction.

To this end, this roofing structure, adapted for example to form vault, possibly transparent or translucent, for covering a zone located between two supports generally parallel in a longitudinal direction, composed of a plurality of juxtaposed roofing plates, located at one or more levels, and of hoop elements disposed transversaly between the two longitudinal supports, each of these hoop elements being constituted by at least two elementary hoop elements comprising a lower hoop element and an upper hoop element superposed on the lower hoop element, the transverse edges of the plates being engaged between the lower and upper hoop elements of each pair, is characterized in that it comprises means for provoking deformation of one of the superposed hoop elements by applying it under pressure against the other and thus effecting gripping of the plates between the superposed elementary hoop elements.

According to an embodiment of the invention, the means for provoking deformation of one of the superposed elementary hoop elements comprise means which exert a tangential traction at each end of the upper hoop element, each end of the lower hoop element being fast with the adjacent longitudinal support or in abutment thereon, so that the upper hoop element, deformed in traction, exerts a regularly distributed linear pressure on the edges of the roofing plate and the lower hoop element.

According to a variant embodiment, the means provoking deformation of one of the superposed elementary hoop elements comprise means which exert a tangential thrust at each end of the lower hoop element, each end of the upper hoop element being fast with the adjacent longitudinal support or in abutment thereon, so that the lower hoop element, deformed by thrust, exerts a pressure beneath the roofing plate and the upper hoop element.

The different modes of deformation, by traction of the upper hoop element or compression of the lower hoop element, make it possible to apply one of the superposed elementary hoop elements under pressure against the other, acting from the ends of these hoop elements. Therefore, contrary to certain existing structures, the fixing members are not distributed over the length of the hoop elements. Furthermore, it should be noted that the modes of deformation carried out enable the transverse edges of the plates to be gripped between the elementary hoop elements without having to resort to seals. This is mainly due to the fact that the modes of deformation effect an application under pressure of the upper hoop element against the lower hooper element, or vice versa, which is translated by a substantially uniform grip of the transverse edges of the materials constituting the structure in the longitudinal and transverse sense.

BRIEF DESCRIPTION OF THE DRAWINGS

The invention will be more readily understood on reading the following description with reference to the accompanying drawings, in which:

FIG. 34 is a view in longitudinal section through the zone of connection between a crosspiece and hoop elements, this section being made along line B—B of FIG. 35.

FIG. 35 is a view in transverse section along the line F—F of FIG. 34.

FIG. 36 is a view in transverse section along line G—G of FIG. 34.

DESCRIPTION OF THE PREFERRED EMBODIMENTS

Figures 1, 2, 3, 4, 5, 6, 7:
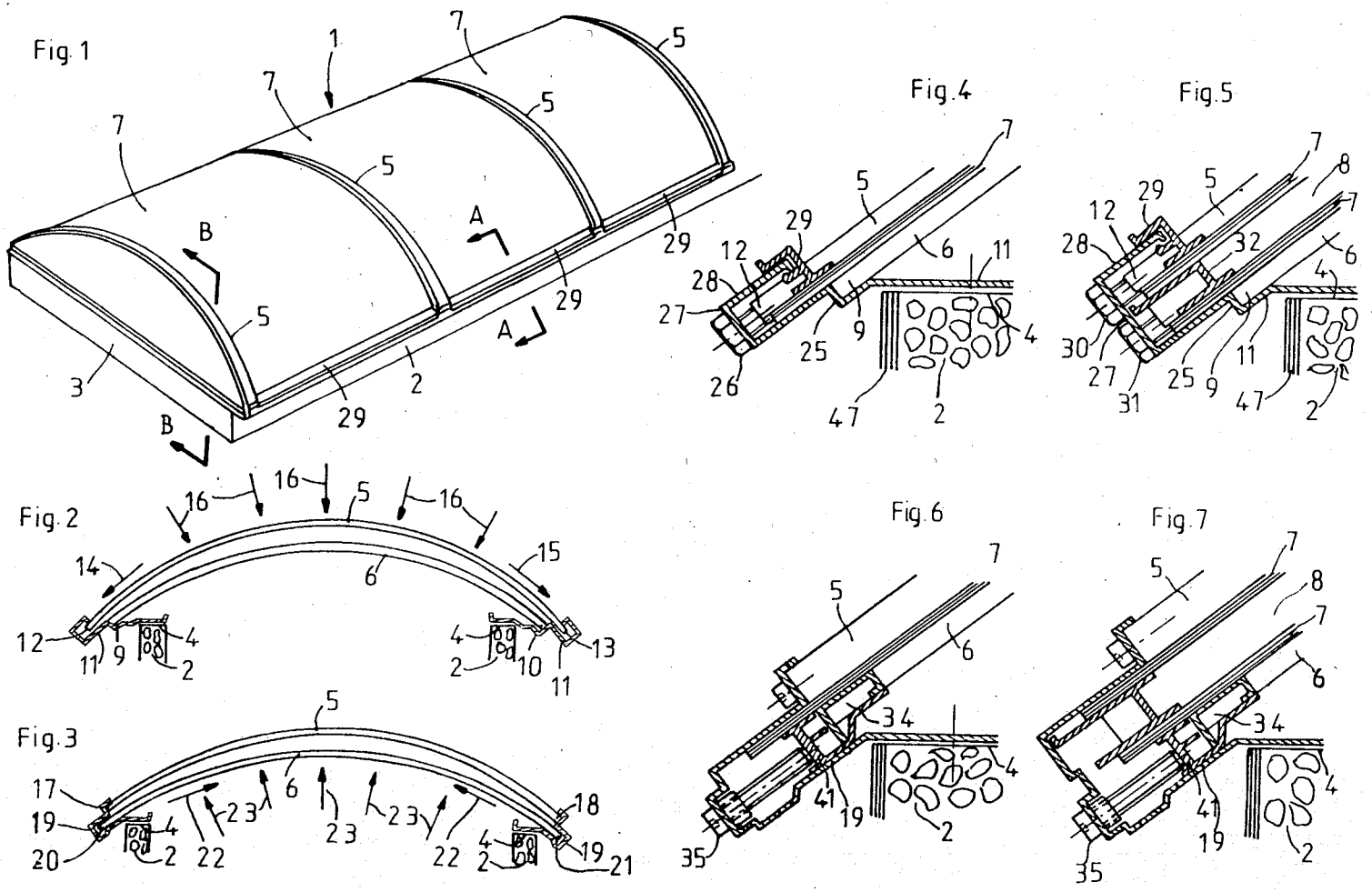
FIG. 1 is a perspective view of the whole of a structure according to the invention.
FIG. 2 is a schematic view in transverse section illustrating the deformation of the upper elementary hoop element, by traction, with respect to the lower hoop element.
FIG. 3 is a schematic view in transverse section illustrating the deformation of the lower elementary hoop element, by thrust with respect to the upper hoop element.
FIGS. 4 and 5 are partial views in section along line A—A of FIG. 1, for the mode of deformation shown schematically in FIG. 2, in the case of a structure with one and with two surface levels, respectively.
FIGS. 6 and 7 are partial views in section along line A—A of FIG. 1, for the mode of deformation shown schematically in FIG. 3, in the case of a structure with one and with two surface levels, respectively.

Referring now to the drawings, FIG. 1 shows a structure 1 in the form of a vault which covers a zone defined by two generally parallel longitudinal supports 2, connected or not at their ends by transverse supports 3. The whole of these supports defines for example a cut which projects with respect to the surface of a roof and which defines an opening in this roof which this structure 1 covers. The upper surface 4 of the supports 2 is substantially horizontal. The structure 1 further comprises longitudinal end sections 11 and 19 fast with the supports 2. It also comprises hoop elements oriented transversaly with respect to the longitudinal direction defined by the supports 2 and spaced out longitudinally. Each of these hoop elements is in fact constituted by at least two superposed elementary hoop elements, namely an upper hoop element 5 and a lower hoop element 6.

Between the upper and lower hoop elements 5 and 6 respectively, are engaged the transverse edges of roofing plates 7, generally transparent or translucent. These plates are for example made of a plastic material or a resin and they are supple enough to be cold bent for assembly purposes.

The structure 1 presents one or more surface levels. In the case of the structure presenting more than one surface level, an intermediate hoop element is interposed betwen an upper hoop element 5 and a lower hoop element 6 of the same pair, all these hoop elements 5, 6, 8 being superposed. Unless indicated to the contrary, an intermediate hoop element 8 shall be considered as an upper hoop element with respect to a lower hoop element 6 and as a lower hoop element with respect to an upper hoop element 5.

The transverse edges of the roofing plates 7 are gripped between the upper hoop elements 5 and lower hoop elements 6 and the gripping is effected by deformation of one of the superposed elementary hoop elements and the pressure exerted by this deformed hoop element on the other. This gripping is effected without the use of members for fixing the hoop elements together, distributed over their length, nor of seals between the plates and the hoop elements. However, this gripping is effected in a totally water-tight manner with respect to the interior of the construction, whilst allowing free expansion of the plates and the collection of the possible infiltration water through the lower hoop element.

FIGS. 2 and 3 schematically show two modes of deformation of one of the elementary hoop elements allowing such a gripping of the plates.

In FIG. 2, the ends 9 and 10 of the lower elementary hoop element 6 are respectively immobilised in position with respect to the flange of the longitudinal end section 11 fast with each support, this flange being oriented substantially perpendicularly with respect to the curve defined by the hoop element 6. This immobilisation may be an abutment or it may be ensured by a set screw. In this case, it is the upper hoop element 5 which is deformed and this deformation consists in exerting a traction on the ends 12 and 13 of the upper hoop element 5, this traction being substantially parallel to the tangent to the bottom point of the curve which it defines. Such a traction is schematically shown by arrows 14 and 15. This traction provokes tensional stresses inside the upper hoop element 5 which is consequently applied, by deformation, over the whole of its length, on the lower hoop element 6. This is translated by the appearance of a pressure exerted by the upper hoop element 5 on the lower hoop element 6, this pressure being perpendicular to each point of the curve defined by the upper hoop element 5. Such a pressure is schematically shown by arrows 16. The transverse edges of the roofing plates 7 which are inserted in and between the elementary hoop elements 5 and 6 are therefore gripped over the whole of their length.

In the variant embodiment illustrated in FIG. 3, it is the ends 17 and 18 of the upper hoop element 5 which are respectively immobilised in position, for example with respect to the flange of a longitudinal end section 19 fast with each of the supports 2. This immobilisation may be an abutment or it may be ensured by a screw. In this case, the mode of deformation consists in exerting a thrust on the ends 20 and 21 of the lower hoop element 6, this thrust being shown schematically by arrows 22. This thrust is oriented parallel to the tangent to the bottom point of the curve defined by the lower hoop element 6. It provokes, over the whole length of the lower hoop element 6, a pressure oriented perpendicularly to each point of the curve defined by the lower hoop element 6, this pressure being shown schematically by arrows 23. The lower hoop element 6 is thus applied under pressure over the whole of its length, against the upper hoop element 5 and the edges of the plates are inserted and gripped between the hoop elements 5 and 6.

The two modes of deformation which have just been described enable the assembly between the upper hoop elements 5, the lower hoop elements 6 and the roofing plates 7 to be adjusted without having to resort to fixing members distributed over the length of the hoop elements, nor to seals, being given that a deformation by traction or by thrust is exerted on one hoop element with respect to the other.

FIGS. 4 and 5 are relative to an embodiment corresponding to the mode of deformation shown schematically in FIG. 2. In FIG. 4, the end 9 of the lower hoop element 6 is in abutment against a flange 25 of the section 11. A set screw 26 is provided to exert a traction on the end 12 of the upper hop element 5. This screw 26 is oriented parallel to the tangent to the bottom point of the curve of the hoop element 5. Its head abuts on a flange 27 of the section 11, this flange being oriented perpendicularly to the axis of the screw and offset outwardly with respect to flange 25 for a reason which shall be specified hereinbelow. The threaded part of the screw 26 is screwed in one or more tapped housings in the end 12 of the upper hoop element 5.

As may be seen in FIG. 4, sections 29 are interposed betwen the different upper hoop elements 5, these sections 29 ensuring a longitudinal fixation of the roofing plates 7 in the longitudinal end section 11. This section 29 is of any appropriate form, for example the one shown in FIG. 4 which advantageously allows it to be fitted in the end part of the flange 28 of the longitudinal end section 11.

FIG. 5 shows a variant of the embodiment shown in FIG. 4, in which variant the structure 1 presents two levels of roofing plates. The traction members 30 and 31, such as screws, are preferably respectively engaged in the ends of the upper hoop element 5 and the intermediate hoop element 8. The end section 11 has substantially the same shape as that described with reference to FIG. 4, apart from the fact that its flange 27 has an upper width which constitutes a support surface for the heads of the screws 30 and 31. A section 32 is preferably interposed between the ends of the different successive intermediate hoop elements.

FIGS. 6 and 7 relate to embodiments corresponding to the mode of deformation shown schematically in FIG. 3. In these figures, the end 34 of the lower hoop element 6 is subjected to a thrust made with the aid of a screw abutting on a flange of the longitudinal end section 19. The thrust exerted by the screw 35 may possibly be effected by a longitudinally oriented section 41.

In the embodiments of FIGS. 1 to 7, the end of the longitudinal sections 11 and 19 formed by a U-section oriented towards the outside of the structure and of which the lower level is located below the level 4 of the support 2, presents means for collecting, chanelling and evacuating the water of condensation of the structure and the water which has possibly infiltrated. Moreover, the section 11 and 19 presents discharge holes which avoid the water possibly collected by these sections flowing inside the construction.

Figures 8, 9, 10, 11, 12, 13, 14:
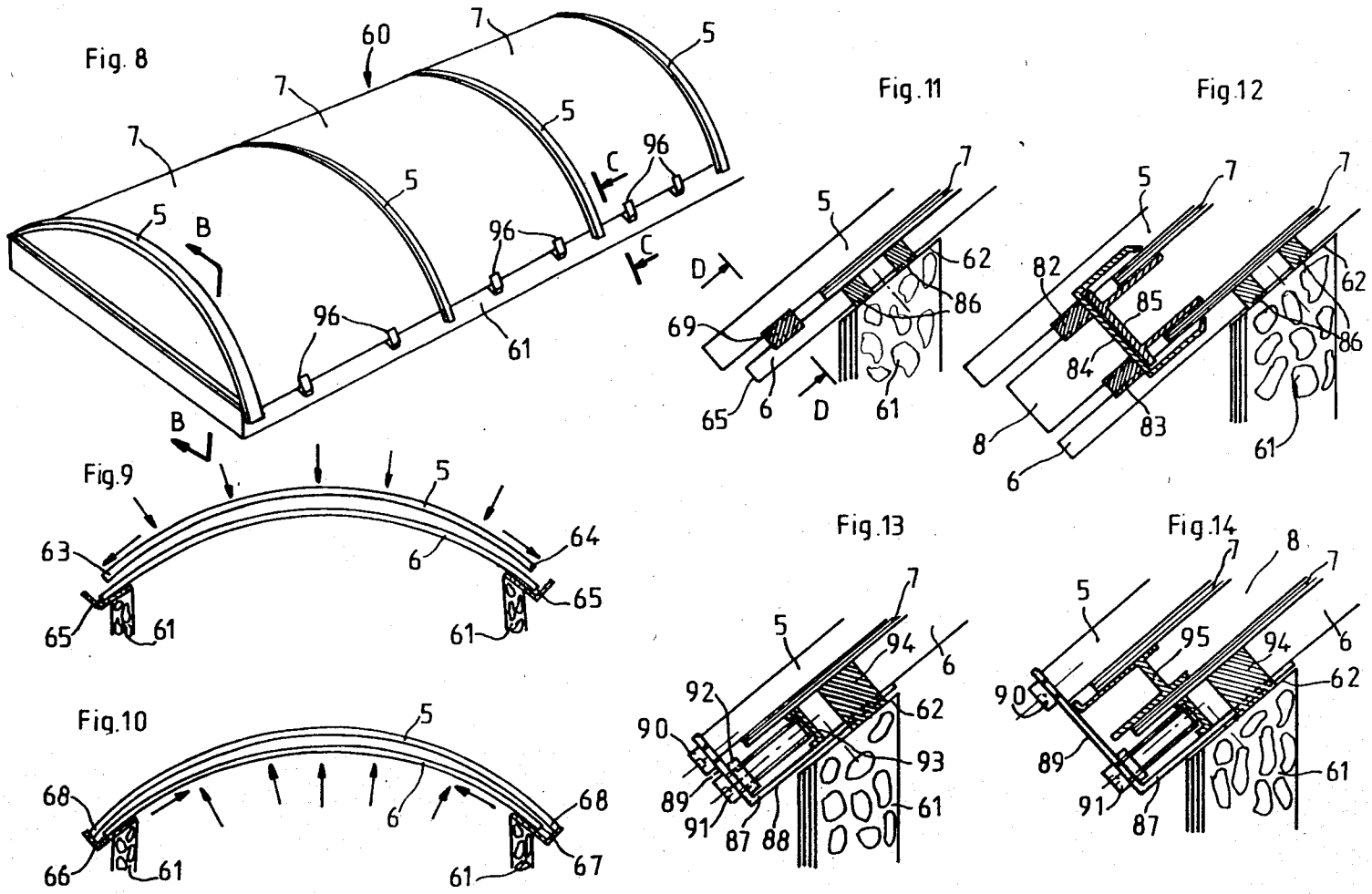
FIG. 8 is a view in perspective of a variant embodiment of the whole of the structure.
FIG. 9 is a schematic view in transverse section illustrating the deformation in traction of the upper hoop element, in the case of the structure of FIG. 8.
FIG. 10 is a schematic view in transverse section illustrating the deformation in thrust of the lower hoop element, in the case of the structure of FIG. 8.
FIGS. 11 and 12 are partial views in section along line C—C of the structure shown in FIG. 8, for the mode of deformation schematically shown in FIG. 9, in the case of a structure with one and with two surface levels, respectively.
FIGS. 13 and 14 are partial views in section along line C—C of the structure shown in FIG. 8, for the mode of deformation shown schematically in FIG. 10, in the case of a structure with one and with two surface levels, respectively.

FIG. 8 shows a variant embodiment of a structure 60 in which the longitudinal supports 61 present either an inclined upper face 62 substantialy parallel to the tangent to bottom point of the curve of the hoop elements at their ends, or a substantially horizontal face, in which case the inclination is compensated by an appropriate bracket. As in the preceding case, the transverse edges of the roofing plates 7 are gripped by deformation of one of the superposed hoop elements on the other.

FIG. 9 illustrates a deformation by traction at the ends 63 and 64 of the upper hoop element 5, the ends 65 of the lower hoop element 6 being immobilised with respect to the supports 61, via a bracket for example.

FIG. 10 illustrates a deformation by thrust at the ends 66 and 67 of the lower hoop element 6, the ends 68 of the upper hoop element 5 being immobilised with respect to the supports 61.

The stresses provoked by these deformations are similar to those described respectively with respect to FIGS. 2 and 3.

Figure 15:
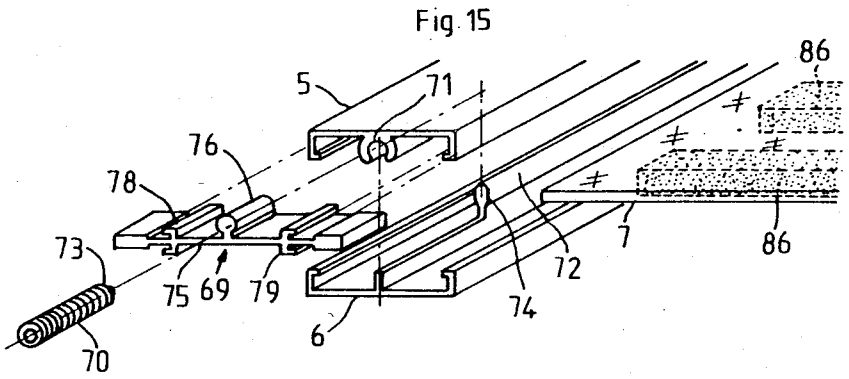
FIG. 15 is an exploded perspective view of the end part of the hoop elements shown in FIG. 11.
Figure 16:
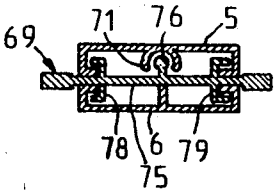
FIG. 16 is a view in transverse section along line D—D of FIG. 11.

FIGS. 11 to 16 are relative to embodiments more particularly adapted to the nature of the supports 61. In FIG. 11, the end of the lower hoop element 6 is rendered directly fast with the support 61. In other words, longitudinal sections such as sections 11 or 19, are absent. This connection may be effected for example by screwing the inner face of the hoop element 6, at its end, to the upper surface 62 of the support 61. A seal may possibly be disposed at that spot. The end 65 of the lower hoop element 6 projects with respect to the support 61. The deformation of the upper hoop element 5 on the lower hoop element 6, by traction, is preferably effected by means of an intermediate piece 69 which is illustrated in FIGS. 15 to 17, relative to a determined embodiment of the hoop elements 5 to 6.

Deformation by traction is effected by means of a screw 70 which is tightened in a tubular rib 71 on the upper hoop element 5, tapped at least at its end part. The lower part of this tubular rib is open and, when the hoop elements are superposed, a rib 72 on the lower hoop element 6 engages in the tubular rib 71. When the screw 70 is tightened, its end 73 exerts a pressure on the end of the piece 69 engaged in the rib 71. As this piece 69 abuts on the end 74 of the rib 72 of the lower hoop element 6, the pressure is transferred to the rib 72 of the lower hoop element 6 and as this lower hoop element is fast with the support 61, the screw 70 therefore exerts a traction on the upper hoop element 5, abutting on the end of the piece 69. The piece 69 presents a part 75 parallel to the roofing plates and of thickness equal to or slightly less than said plates. It further comprises a rib 76 oriented towards the upper element 5 and similar to the upper part of the rib 72, this rib 76 engaging in the open tubular rib 71.

In addition, the intermediate piece 69 comprises means for applying the end of the upper hoop element 5 on the end of the lower element 6. These means act from the inside of the hoop elements, which is shown in FIGS. 15 and 16, or from the outside, as shown in FIG. 17. In FIGS. 15 and 16, these means consist of two ribs 78 and 79, in the form of a C, of which the opening is oriented lateraly towards the outside of the hoop elements. These C-shaped ribs imprison the means for gripping the hoop elements 5 and 6 for the transverse edges of the plates, these means being described hereinafter.

Figure 17:
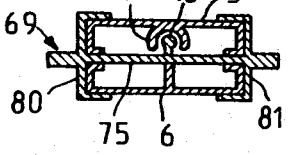
FIG. 17 is a variant of FIG. 16.

In the case of FIG. 17, the means for application of the intermediate piece 69 comprise two C-shaped ribs 80 and 81 of which the opening is oriented laterally towards the inside of the hoop elements. These ribs imprison the hoop elements 5 and 6 by abutting respectively on their upper face and on their lower face. The mode of assembly is identical to that described previously.

FIG. 12 shows a variant of FIG. 11 for a structure presenting two levels of roofing plates. The principle is similar to that which was described previously and two intermediate pieces 82 and 83 ensure connection of the ends of the hoops elements 5 and 8, on the one hand, 8 and 6 on the other hand. The screw corresponding to the intermediate piece 82 is tightened in a tapped tubular rib in the upper hoop element 5, whilst the screw corresponding to the intermediate piece 83 is tightened in a tapped tubular rib in the intermediate hoop element 8. Furthermore, two longitudinal sections 84 and 85, fitted in each other, preferably present flanges which act, during tightening, like clamps with respect to the longitudinal edges of each level of roofing plate and maintain a constant distance between the roofing plates 7, ensuring tightness at this spot between the hoop elements. These sections present, for example, a section similar to that shown in FIG. 12. With a view to ensuring tightness, a seal 86, single or double, is interposed between the upper face 62 of the support 61 and the lower face of the roofing plates 7. The seals 86 are disposed between the different hoop elements and ensure tightness between the roofing plates and the support 61.

An embodiment of the mode of deformation shown schematically in FIG. 10 is shown in FIG. 13. In this case, the hoop elements abut on or are deformed with respect to a bracket 87 having a width substantially equal to that of the hoop elements. The bracket 87 presents a flange 88 which is rendered fast, for example by screwing, with the upper face 62 of the support 61. The end of the upper hoop element 5 is rendered fast with the other flange 89 of the bracket 87, for example by means of a screw 90. A screw 91, in combination for example with a tapped nut 92, exerts a thrust on the end of the lower hoop element 6, possibly via an intermediate longitudinal section 93 of length substantially equal to the width of the hoop elements. One or more seals 94 interposed between the roofing plates and the upper face 62 of the support 61 and disposed between two consecutive lower hoop elements ensure water-tightness with respect to the interior of the construction.

FIG. 14 shows a variant of the embodiment shown in FIG. 13, in the case of the structure having two levels of roofing plates. This embodiment is similar to the preceding one, apart from the fact that the flange 89 of the bracket 87 is of longer length. Furthermore, a longitudinal section 95 is interposed between the longitudinal edges of the roofing plates 7, constituting the two levels, and disposed between two consecutive intermediate hoop elements ensuring tightness at this spot and the spaced apart relationship between the two superposed plates.

Figure 18:
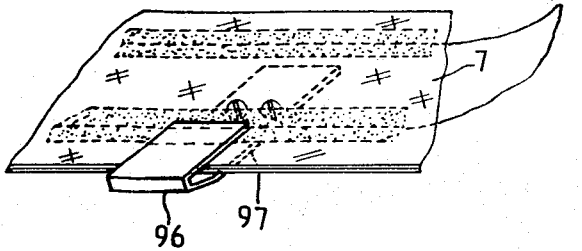
FIG. 18 is a view in perspective of a detail of embodiment of the structure shown in FIG. 8.
Figure 20:
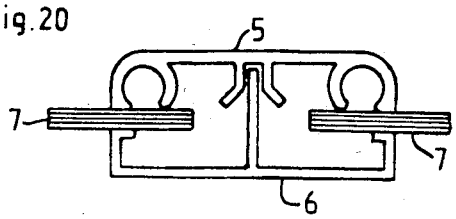
FIGS. 20, 21, 22, 23, 25, 26 and 27 are views in transverse section through different sections constituting hoop elements.
Figure 25:
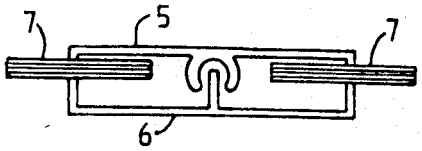
Figure 21:
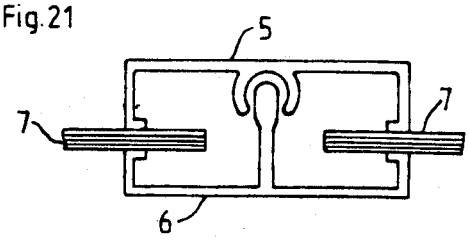
Figure 26:
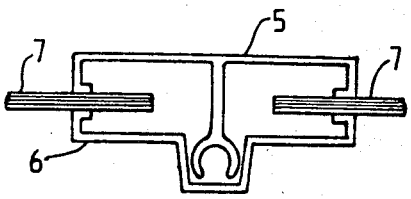
Figure 22:
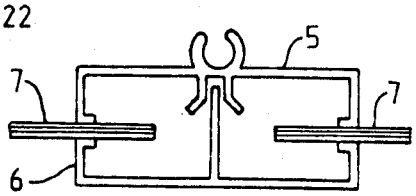
Figure 27:
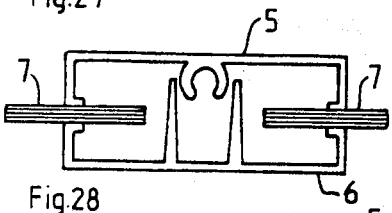
Figure 23:
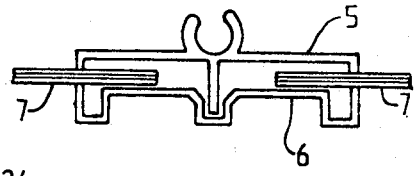

The structure 60 shown in FIG. 8 further preferably presents clips 96 for holding the longitudinal edges of the roofing plates 7. These holding clips 96 are distributed between consecutive superposed hoop elements. FIG. 18 shows a non-limiting embodiment of a clip 96 in the form of a flattened C, one arm 97 of which is fast with the upper face 62 of the support 61, for example by screwing. This arm 97 is preferably longer than the other. The longitudinal edges of the roofing plates 7 are engaged in the groove constituted by the flattened C-shape and are consequently maintained therein. It should be noted that the spaced apart relationship between the horizontal arms of the C is determined as a function of the thickness of the seals 86 or 94, so that the longitudinal edges of the plates exert a substantially constant and uniform pressure on the seals, between two consecutive assemblies of superposed hoop elements.

Figure 19:
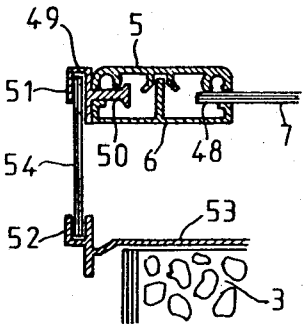
FIG. 19 is a partial view in section along line B—B of the structures shown in FIGS. 1 and 8.

FIG. 19 illustrates an embodiment of a longitudinal end of the structure shown in FIGS. 1 and 8. At this spot is located a pair of elementary hoop elements, an upper one 5 and lower one 6, between which the transverse edge 48 of a roofing plate 7 is gripped from the inside. On the outside of the structure, a section 49 presents a flange 50 of thickness substantially equal to that of the roofing plate 7 and which is gripped between the hoop elements 5 and 6. The section 49 further presents a part 51 in the form of an inverted U which is located opposite another part 52, in U-form, of a section 53 fast with the support 3. The upper and lower transverse edges of a vertical end plate 54 are engaged in the two U-shaped parts 51 and 52 of the sections 49 and 53. The assembly of the section 49 and more precisely of this flange 50 between the hoop elements 5 and 6 is similar to that of the end 48 of the roofing plate 7, and the flange 50 is gripped between the hoop elements during tightening, which renders the end piece, constituted by the plate 54 and the section 49, fast with the longitudinal structure.

In addition to the deformation means which have just been described, lower and possibly intermediate hoop elements also comprise guide means which are preferably continuous over their length. These guide means are generally constituted by at least one rib for one of the hoop elements, which is oriented towards the other hoop element which is engaged in a groove therein. This groove may be constituted by two paralel ribs or may be obtained by shaping the section constituting the hoop element. It should further be noted that the guide means traverse the level defined by the roofing plates 7, between two juxtaposed plates, in order to avoid disconnection of the roofing plates from the hoop elements due to their free expansion.

FIGS. 20 to 28 illustrate different variant embodiments of the cross section of the sections constituting the upper and lower hoop elements. These figures illustrate the means for gripping the plates, the guide means and the means for tightening the hoop elements at their ends. The sections of the hoop elements are generally symetrical with respect to a substantially vertical plane and they present, on either side of this plane, means for gripping the roofing plates 7. These gripping means are preferably constituted by flanges of the sections, opposite for a superposed lower hoop element and upper hoop element, these flanges possibly being reinforced by inner raised edges. The means for tightening the screws, for a deformation by traction or by thrust, are preferably constituted by a tubular rib open over the whole length of the section and tapped at each end.

Figure 28:
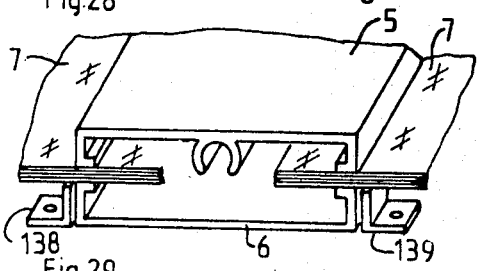
FIGS. 24, 28 and 29 are views in perspective of variant embodiments of the end of upper hoop elements and of lower hoop elements.

In the embodiment shown in FIG. 28, the means for guiding the lower hoop element 6 are in the form of brackets 138 and 139 fast with the support 61 and of which the distance is substantially equal to the width of the lower hoop element 6. The upper hoop element 5 is guided with the aid of the traction screw of the upper hoop element 5, this screw traversing and abutting on the flange of a bracket fast with the support 61.

Figure 24:
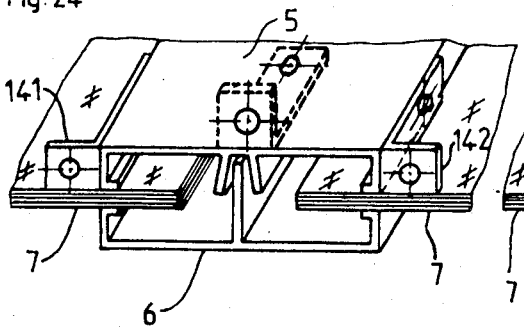

Furthermore, the embodiment illustrated in FIG. 24 advantageously enables the upper hoop element 5 to be made of a plurality of portions assembled end to end.

Figure 29:
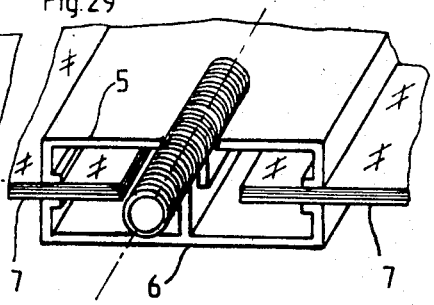
Figure 30:
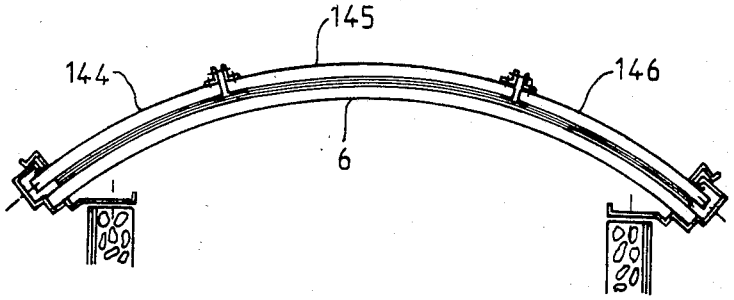
FIG. 30 is a view in elevation of an upper hoop element composed of a plurality of portions disposed end to end.

By way of example, FIG. 30 shows an upper hoop element composed of three portions 144, 145, 146 assembled by screwing or by bolting end to end. This screwing may also be effected as means for deformation of the upper hoop element 5 on the lower hoop element 6. In fact, in this case, it sufficies to provide a space between the different lugs fast with the upper hoop element 5, such as lugs 141, 142 (FIG. 24) and 143 (FIG. 29), and to effect tightening or bolting for assembling the portions of the upper hoop element, similar to what is effected at the ends of a hoop element.

In addition, as visible in particular in the embodiments shown in FIGS. 20 to 29, the lower hoop element 6 presents one or more channels. The or each channel is defined by the flanges constituting the gripping means, the lower wall of the lower hoop element 5 and part of the guide means. These channels are water-tight over the length of the hoop element. They channel the water which might possibly infiltrate between a roofing plate 7 and a hoop element. The longitudinal support sections naturally present appropriate means for evacuating this water, for example, water outlet orifices. Thus, these channels contribute to the tightness of the structure, as they evacuate the water coming from the outside which might infiltrate between the roofing plates and the hoop elements, more particularly the upper hoop element.

Moreover, it will be noted in FIGS. 20 to 29, that the means for guiding the upper and lower hoop elements are not in contact, in order to avoid a thermal bridge between the air outside the construction and the air inside and thus to eliminate to a maximum the risks of water of condensation forming inside the construction.

Figure 31:
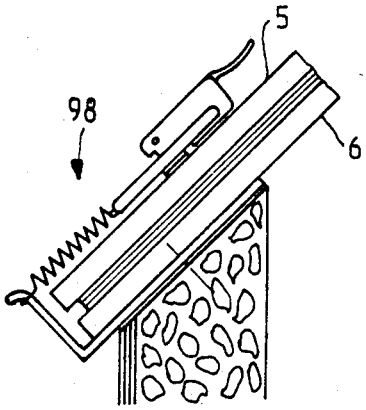
FIGS. 31 and 32 are, respectively, views in profile and in elevation of a variant embodiment of the means for deforming the upper hoop element in traction.
Figure 32:
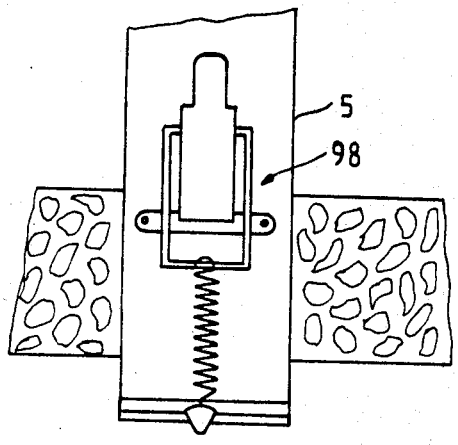

The modes of deformation which were previously described mainly use screws. However, this is not limiting and any other device for exerting a traction on the upper hoop element or a pressure on the lower hoop element is suitable. FIG. 29 shows a threaded rod 143 which is longitudinally welded to the end of the upper hoop element 5 and whereon a nut (not shown) is screwed for tensioning the upper hoop element. By way of example, FIGS. 31 to 32 show a device of the lever and spring type 98.

Figure 33:
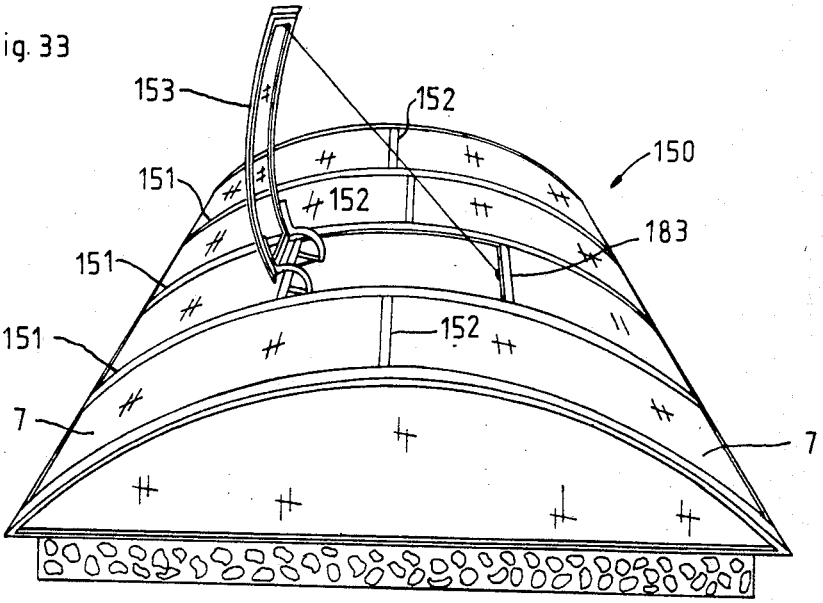
FIG. 33 is a perspective view of the whole of a structure presenting connecting crosspieces between the hoops and an opening.

FIG. 33 shows a structure 150 whose span requires lengths of plates which render the assembly of the structure expensive and difficult. It presents roofing plates 7 which are juxtaposed both in the longitudinal direction and in the transverse direction. The plates are joined in the transverse direction by means of hoop elements 151, similar to those which have been described. The joint of the roofing plates 7 in the longitudinal direction is effected by means of connecting crosspieces 152. These crosspieces connect two assemblies of successive superposed hoop elements and their number depends on the span of the structure. The connecting crosspieces further enable opening parts such as window 153 to be made, by defining, in a longitudinal direction, the periphery of the opening and that of the window itself, the hoop elements 151 defining the opening in the transverse direction. The hoop elements are of any appropriate nature and for example are shaped as illustrated in FIGS. 20 to 29. However, the lower hoop element presents a longitudinal tubular reinforcing chamber 173 in its lower part (FIG. 34).

FIGS. 34 to 36 show in transverse section the crosspiece sections and the connection between a crosspiece and the hoop elements, in the case of the crosspiece presenting two surface levels. FIGS. 34 and 35 show an upper hoop element 5, a lower hoop element 6 and an intermediate hoop element 8. The connecting crosspiece presents, in register with the hoop elements, an upper section 155, a lower section 156 and an intermediate section 154. The sections of the crosspiece, as well as the hoop elements, grip the edges of roofing plates 7.

The crosspiece sections 155, 156 and 154 are superposed and maintained in position with respect to one another by guide means.

The upper section 155 is approximately in the form of a very open upturned V, of which the ends of the two arms 158 and 159 constitute part of the gripping means for the upper level of the roofing plates 7.

The lower section 156 is approximately in the form of a U of which the ends of the two arms 160 and 161 constitute part of the means for gripping the lower level of the roofing plates 7.

The intermediate crosspiece section 154 is approximately in the form of an H, of which the upper and lower ends of the arms 162 and 163 are respectively opposite the ends of arms 158, 160 and 159, 161 and constitute a complement for the means gripping the roofing plates 7.

The guide means are constituted, for the lower section 156, by a central rib 143, oriented longitduinally with respect to the crosspiece, which is engaged in a rib 164, in the form of an upturned U, on the intermediate element 154. The rib 164 extends vertically by a single rib 165, in the axis of the rib 143, and which engages in a rib 166, in the form of an upturned U, on the upper section 155. It will be noted that the means for guiding the sections 154, 155, 156 are in the same longitudinal plane, which enables the section 155 to be directly fitted in the section 156 in the case of one level of roofing plates.

In addition, the single ribs 143 and 165 and the upturned U ribs 164 and 166 associated therewith preferably do not present any mechanical contact with one another, so as to avoid any thermal bridges.

The ends of the arms of the ribs 164 and 166, in the form of an upturned U, extend laterally by respective flanges 167, 168. The upper face of the flanges 167 and 168 is located at a level equal to or slightly higher than the level of the lower face of the roofing plates 7. The thickness of the flanges 167 and 168 is substantially less than the thickness of the roofing plates 7 disposed at their level. Furthermore, the lower face of the lower section 156 of the crosspieces presents at least one projecting rib. By way of illustration, two ribs 169 and 170 have been shown in FIG. 35. The dimensions of the sections constituting the crosspiece are determined so as to be in relation with those of the hoop elements of which they ensure connection, mainly in height. The purpose of these ratios between the dimensions is to ensure continuity between the longitudinal and transverse zones of grips of the edges of the roofing plates.

The connection between a crosspiece and the superposed hoop elements is effected by fitting or gripping the ends of the crosspiece sections in the hoop elements and between the superposed hoop elements.

The lower section 156 presents, at each end, a projecting part 171 which is constituted by the lower face and the lower part of the arms of the U. This part 171 is fitted in an orifice 172 in the lateral wall of the lower hoop element 6, said orifice being of substantially corresponding form. This orifice is pierced in the lateral wall with a watertight tubular chamber 173 located in the lower wall of the lower hoop element 6. The lower edge of the orifice 172 is located at a sufficient distance above the lower face of the tubular chamber 173, in order to allow the water recovered by the connecting crosspiece to flow inside the lower hoop element 6. For the upper section 155 and the intermediate section 154, the flanges 168 and 167 extend beyond the ends of these sections and constitute respective projections 174 and 175. The projections 174 and 175 are located substantially at the level of the roofing plates 7 and they extend respectively between the upper hoop element 5 and the intermediate hoop element 8 and between the intermediate hoop element 8 and the lower hoop element 6.

In the projecting part 171 of the lower section 156, the projecting ribs 169 and 170 each present a notch 176 which overlaps the lower edge of the orifice 172 provided in the lateral wall of the lower hoop element 6, which avoids disconnection when the structure is assembled.

Thus, the different sections constituting a crosspiece are fitted in the hoop elements or between the hoop elements and the assembly of the hoop elements by deformation, by traction or by thrust brings about assembly of the sections constituting the crosspiece and the grip of the roofing plates 7 between the hoop elements and between the sections of each crosspiece.

The central open tubular rib of the lower section 156 may possibly be tapped at the ends so as to render this section 156 fast with a door upright, window, etc.

It should be noted that the roofing plates 7 are mounted directly between the sections constituting a crosspiece, without resorting to seals, and they allow free expansion.

In the same way as the hoop elements, the crosspiece present means for collecting and evacuating possible water infiltrating from the outside, which might infiltrate between the roofing plates and the sections constituting the crosspieces.

As for the hoop elements, channels are defined for the sections constituting a crosspiece and in particular the lower section 156 and the intermediate section 154. These channels are laterally defined by the flanges of the sections and by the ribs constituting the guide means. They are defined in their lower part by the lower part of the sections. It should be noted that, at the level of the lower section, the projecting part 171 extends the channels of this section inside the tight tubular chamber 173. In this way, the running water which may infiltrate in the sections of the crosspiece towards the lower section 156 is channelled and evacuated towards the outside through the watertight tubular chamber 173 of the lower hoop element 6, which is provided at each of its ends with means for evacuation to the outside.

A crosspiece is generally inclined transversaly, being given that it follows the curvature of the hoop elements at the point of connection. In this way, the water which may infiltrate accumulates only on one side of the crosspiece, i.e. the side oriented towards the top of the slope. In FIG. 35, it has been assumed that the left-hand side of the Figure is oriented towards the slope. It is therefore necessary to provide orifices for evacuating the infiltration water from the intermediate section 154 towards the lower section 156. The means for chanelling the running water towards the section 156 comprise, for the intermediate section 154, orifices 177 which are pierced in the horizontal arm of the H formed by this section and on the left-hand side of FIG. 35. These orifices 177 allow the water which may infiltrate between the upper level of the roofing plates 7 and the upper section 155 to flow in the direction of the lower part of the lower section 156.

The orifices 177 in the intermediate section 154 located on the right-hand side of FIG. 35, i.e. towards the lower level of the slope are equipped with funnels 179 wihch define, with each orifice 177, a watertight channelling tube opening out beneath the level of the roofing plates 7 of the lower level. In this way, the possible infiltration water is directly channelled towards the channels of the lower section 156 without risk of infiltration between the upper face of the roofing plate 7 of the lower level and the lower edge of the flange 163 of the intermediate section 155.

At the ends of the intermediate section 154, stops 178 hermetically obturate the water evacuation channels defined by this section. These stops are for example asembled at the horizontal part of the H, by screwing.

The channels of the lower section 156, and more particularly the channel oriented towards the top of the slope, channel the water towards the interior of the watertight tubular chamber 173 of the lower hoop element 6, whence it is evacuated towards the outside. It should be noted that the channels of the lower section 156 open out in the watertight tubular chamber 173 at a level at least equal to the level which the water might reach in this chamber, so as to avoid saturation or overflow of this chamber.

In this way, tightness is ensured inside the construction, as all the water likely to infiltrate between the roofing plates and the hoop elements or the crosspiece sections is evacuated towards the outside via the interior of the hoop elements and the crosspiece sections.

Furthermore, the lower section 156 of the crosspiece is preferably laterally provided with two gutters 181 and 182 which collect the water of condensation of the structure. These gutters extend in the projecting part 171 and open out in the tight tubular chamber 173 via the opening 172. In this way, the water of condensation is also collected, channelled and evacuated.

Figure 37:
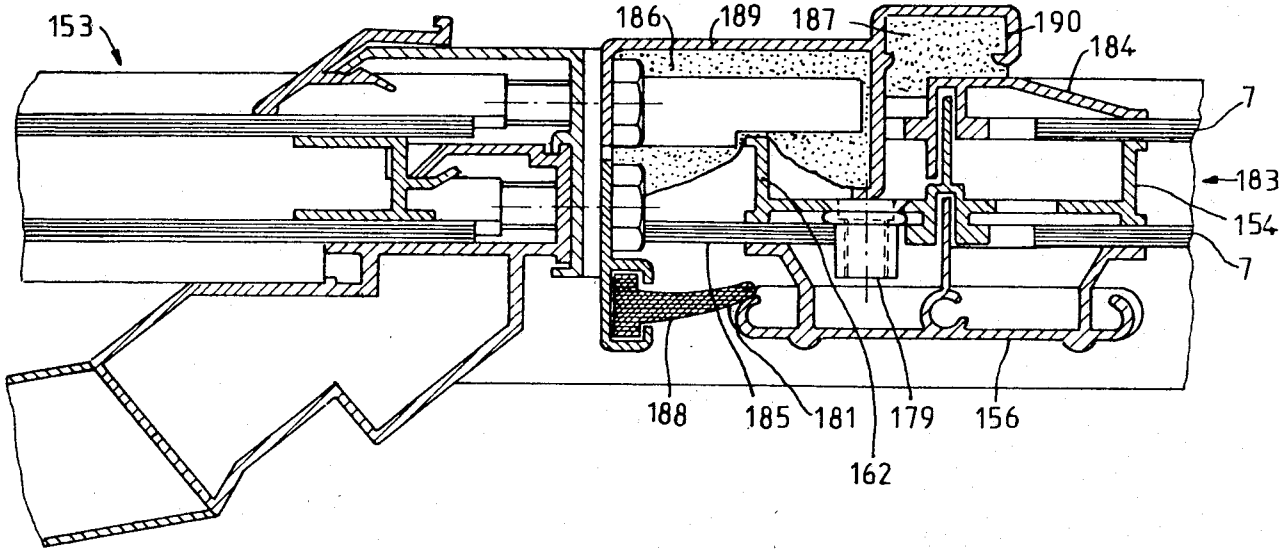
FIG. 37 is a view in section through the zone of connection between the end of an opening and a connecting crosspiece of the structure.

FIG. 37 schematically shows the connection between an opening, such as the window 153 shown in FIG. 33, and a crosspiece which defines the opening in a longitudinal direction. This crosspiece which is indicated by reference 183 in FIG. 33, is similar to the crosspiece which was described with reference to FIGS. 34 and 36, apart from the fact that the upper section 184 is truncated on the opening side. On the other hand, the roofing plates located on the opening side are absent and the plate of the lower level is replaced by a shim 185. At its ends, th crosspiece 183 presents the same means for fitting in the hoop elements and for gripping between the hoop element as the one described previously. The connection between the crosspiece and the end of the opening is rendered substantially watertight by means of seals which are preferably three in number and which are indicated in FIG. 37 by reference 186, 187 and 188. The seal 186 abuts on the flange 162 of the intermediate section 154 and, at each of its ends, on the upper face of the upper hoop element 5 of the fixed structure. The seal 187 abuts on the upper part of the upper section 184, as well as on the upper face of the upper hoop element 5 of the fixed structure. Seals 186 and 187 are flexible and housed in cavities 189 and 190 which are defined for example by the flanges of a section fast with the end of the opening 153. These two seals thus render the lateral part of the opening structure watertight at this spot.

The seal 188 is itself preferably in the form of a lip. It is semi-rigid and abuts against the wall of the gutter 181 of the lower section 156. This seal 188 effects an insulation between the inner and outer parts of the construction and thus avoids water of condensation inside the construction to a maximum.

Figure 38:
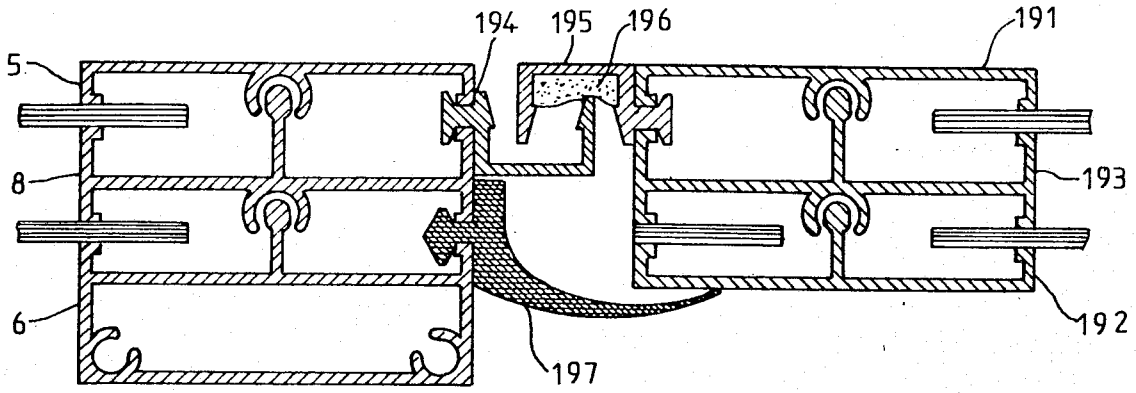
FIG. 38 is a view in section throught the zone of connection between hoop elements of the fixed structure.

FIG. 38 schematically illustrates the connection between the hoop elements 5, 6 and 8 of the fixed structure and hoop elements 191, 192 and 193 of the opening structure. This connection comprises two U shaped sections 194; 195 disposed head to tail. The section 194 is gripped between the upper hoop element 5 and the intermediate hoop element 8 of the fixed structure whilst the section 195 is gripped between the upper hoop element 191 and the intermediate hoop element 193 of the window. The section 195 of the window is naturally above the section 194 of the fixed structure and overlaps one of its arms.

A seal 196 is housed in the section 195, thus avoiding that the rain water penetrate inside the construction if the section 194 is filled faster than it can discharge the collected water.

Tightness is also ensured by two similar seals 197 and 198, the seal 198 being gripped between the intermediate hoop element 8 and the upper hoop element 6 of the fixed structure and the seal 197 being gripped between the intermediate hoop element 193 and the lower hoop element 192 of the opening. The external rounded face of seal 198 closely engages the external arm of the section 195 of the opening whereas the external rounded face of seal 197 closely engages the external arm of section 194 of the fixed structure when the opening is closed. Thus these seals 197 and 198 allow a double isolation with respect to the exterior and the seal 198 avoids that the major part of rain water penetrates into the section 194 provided to this end to collect and discharge this water.

What I claim is:

1. Roofing structure for covering a zone located between two suports generally parallel in a longitudinal direction, comprising:

a plurality of juxtaposed supple roofing plates located on at least one level;

hoop elements positioned transversally between said two longitudinal supports, each of said hoop elements comprising at least two elementary hoop elements including a lower hoop element and an upper hoop element superposed on the lower hoop element;

said roofing plates each having transverse edges engaged between said lower and said upper hoop elements of each pair;

connecting crosspieces between said hoop elements and extending perpendicularly thereto;

said connecting crosspieces being superimposed sections comprising mutual guiding means between which are engaged the longitudinal edges of said roofing plates; and means for deforming one of said superposed elementary hoop elements with respect to the other arranged to bring about assembly of said sections constituting said connecting crosspieces.

2. The structure of claim 1, wherein each crosspiece comprises at each end thereof a projecting part; said lower hoop element having a lateral wall with an opening therein receiving said part, said opening being at a height ensuring continuity between the zone of gripping of a transverse edge of a plate between the hoop elements and of its longitudinal edge between the sections of said crosspiece, said part also having means for securing same to said lower hoop element.

3. Structure according to claim 1, wherein said connecting crosspiece has an upper section with a projecting part of thickness less than or equal to the thickness of said roofing plates; and said upper section has an upper face located at the level of the upper face of said roofing plates and engaged between two superposed hoop elements.

4. Structure according to claim 2, wherein said lower hoop element has a hollow part; said connecting crosspiece has a lower section which includes means for channelling the water of infiltration towards said projecting part which ensures communication with the hollow part of said lower hoop element.

5. Structure according to claim 1:

said upper section being provided with a guiding rib of upturned U section;

said lower section having a rib engaged in said guiding rib; and the part of said upper section projecting inside said hoop elements being constituted by the extension of the lower part of said guiding rib of the upper section.

6. Structure according to claim 1, comprising:

at least two superposed levels of roofing plates having transverse edges engaged between superposed upper, intermediate and lower elementary hoop elements and having longitudinal edges engaged between superposed upper, intermediate and lower sections of a connecting crosspiece;

said intermediate section being pierced with orifices defining water evacuation channels and ensuring flow of the water of infiltration towards the lower section of said connecting crosspiece; and means at each end of said intermediate section hermetically obturating said water evacuation channels.

* * * * *